US009574535B2

(12) United States Patent
Kobayashi

(10) Patent No.: US 9,574,535 B2
(45) Date of Patent: Feb. 21, 2017

(54) FUEL INJECTION VALVE

(71) Applicant: Tatsuo Kobayashi, Susono (JP)

(72) Inventor: Tatsuo Kobayashi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 14/434,196

(22) PCT Filed: Oct. 3, 2013

(86) PCT No.: PCT/JP2013/076986
§ 371 (c)(1),
(2) Date: Apr. 8, 2015

(87) PCT Pub. No.: WO2014/057866
PCT Pub. Date: Apr. 17, 2014

(65) Prior Publication Data

US 2015/0292460 A1 Oct. 15, 2015

(30) Foreign Application Priority Data

Oct. 12, 2012 (JP) ..... 2012-226891

(51) Int. Cl.
*F02M 61/00* (2006.01)
*F02M 61/08* (2006.01)
(Continued)

(52) U.S. Cl.
CPC ..... *F02M 61/08* (2013.01); *B05B 1/26* (2013.01); *B05B 1/265* (2013.01); *B05B 1/3405* (2013.01);
(Continued)

(58) Field of Classification Search
CPC ..... F02M 61/08; F02M 61/06; F02M 61/12; F02M 61/163; F02M 61/1806;
(Continued)

(56) References Cited

U.S. PATENT DOCUMENTS 1,500,702 A * 7/1924 Eiduck ..... F23D 11/24 239/533.12
2,974,881 A * 3/1961 Garday ..... F02M 61/162 239/533.12
(Continued)

FOREIGN PATENT DOCUMENTS

CN 102459859 A 5/1918
JP 10-9090 1/1998
(Continued)

*Primary Examiner* — Steven K Ganey
(74) *Attorney, Agent, or Firm* — Finnegan, Henderson, Farabow, Garrett & Dunner, LLP

(57) ABSTRACT

A fuel injection valve includes: a needle valve including a seat portion on a tip side thereof; a nozzle body including a seat surface on which the seat portion is placed, and a swirl stabilization chamber on a downstream side of the seat surface, the nozzle body having an injection hole formed so as to have an inlet in the swirl stabilization chamber; a swirl flow generating portion having swirl grooves configured to give a swirling component to fuel to be introduced into the swirl stabilization chamber; and a fuel collision portion provided in a tip portion of the needle valve, the fuel collision portion being configured such that, in a state where the needle valve is opened, the fuel collision portion intersects with a virtual surface extended toward the injection hole from the seat surface included in the nozzle body. This allows dead fuel to be retained in the swirl stabilization chamber and to be introduced into the injection hole in a state where a swirling component has been given to the dead fuel from fuel having the swirling component.

6 Claims, 12 Drawing Sheets

(51) Int. Cl.

| | |
|---|---|
| ***F02M 51/06*** | (2006.01) |
| ***F02M 61/18*** | (2006.01) |
| ***B05B 1/34*** | (2006.01) |
| ***B05B 1/26*** | (2006.01) |
| ***F02M 61/06*** | (2006.01) |
| ***F02M 61/12*** | (2006.01) |
| ***F02M 61/16*** | (2006.01) |

(52) U.S. Cl.
CPC ..... *F02M 51/061* (2013.01); *F02M 61/06* (2013.01); *F02M 61/12* (2013.01); *F02M 61/163* (2013.01); *F02M 61/1806* (2013.01)

(58) Field of Classification Search
CPC .... F02M 51/061; B05B 1/3405; B05B 1/265; B05B 1/26

USPC ..... 239/463, 482, 483, 487, 488, 500, 501, 239/502, 505, 518, 522, 533.11, 533.12, 239/584, 585.1, 585.4, 585.5, 590, 59.5
See application file for complete search history.

(56) References Cited

U.S. PATENT DOCUMENTS

| | | | | |
|---|---|---|---|---|
| 4,520,962 | A * | 6/1985 | Momono | F02M 51/0675 239/488 |
| 4,899,699 | A * | 2/1990 | Huang | F02B 23/105 239/488 |
| 6,105,883 | A | 8/2000 | Takeda et al. | |
| 2010/0314470 | A1 | 12/2010 | Cavanagh | |
| 2012/0056018 | A1 | 3/2012 | Kobayashi | |
| 2013/0270368 | A1 | 10/2013 | Kobayashi | |
| 2013/0327851 | A1 | 12/2013 | Kobayashi et al. | |

FOREIGN PATENT DOCUMENTS

| | | |
|---|---|---|
| JP | 10-252608 | 9/1998 |
| JP | 11-117831 | 4/1999 |
| JP | 2000-130291 A | 5/2000 |
| JP | 2000-154768 | 6/2000 |
| JP | 2001-254658 | 9/2001 |
| JP | 2002-130081 | 5/2002 |
| JP | 2002-332935 | 11/2002 |
| JP | 2010-121557 | 6/2010 |
| JP | 2010-185430 | 8/2010 |
| JP | 2011-163327 | 8/2011 |
| WO | WO 2011/125201 A1 | 10/2011 |
| WO | WO 2012/086003 A1 | 6/2012 |
| WO | WO 2012/114480 A1 | 8/2012 |

* cited by examiner

FUEL INJECTION VALVE

CROSS-REFERENCE TO RELATED APPLICATIONS

This application is a national phase application of International Application No. PCT/JP2013/076986, filed Oct. 3, 2013, and claims the priority of Japanese Application No. 2012-226891, filed Oct. 12, 2012, the content of both of which is incorporated herein by reference.

TECHNICAL FIELD

The present invention relates to a fuel injection valve.

BACKGROUND ART

In regard to an internal combustion engine, supercharged lean burn, a large amount of EGR, and homogeneous-charge self-ignition combustion have been actively studied in recent years for $CO_2$ reduction and emission reduction. According to these studies, in order to maximize effects of the $CO_2$ reduction and the emission reduction, it is necessary to realize a stable combustion state near a combustion limit. Also, while petroleum fuel is being depleted, robustness in stable combustion with various fuels such as biofuel is required. A most important factor for realizing the stable combustion is to reduce an ignition fluctuation of a fuel-air mixture, and to realize homogeneous and stable combustion without any unevenness. This requires easier vaporization by fine fuel spray and uniform atomized particle sizes.

Further, a fuel supply of the internal combustion engine adopts a cylinder injection system in which fuel is injected directly to a combustion chamber for the purpose of improving transient response, improving volume efficiency by evaporation latent heat, and carrying out greatly retarded combustion for catalyst activation at low temperatures. However, the adoption of the cylinder injection system may cause oil dilution caused when spray fuel hits a wall of the combustion chamber as the spray fuel is in a form of liquid droplets, PM (Particulate Matter), and generation of smoke.

In order to take measures against these phenomena, a swirl flow may be given to fuel injected from a fuel injection valve. As the fuel injection valve configured to give a swirl flow to fuel, Patent Document 1 and Patent Document 2 have been known, for example. Particularly, Patent Document 2 describes a fuel injection valve configured such that a swirling component is given to fuel so that fine air bubbles are taken in injected fuel, thereby achieving atomization of the injected fuel by bursting the fine air bubbles.

CITATION LIST

Patent Documents

Patent Document 1: Japanese Patent Application Publication No. 11-117831 (JP 11-117831 A)

Patent Document 2: International Publication No. 2011/125201

SUMMARY OF THE INVENTION

Problem to be Solved by the Invention

However, in the fuel injection valves described in Patent Document 1 and Patent Document 2, fuel retained near that seat surface of a nozzle body on which a seat portion of a needle valve is placed at the time of closing the needle valve, i.e., so-called dead fuel, exists. At the time of closing the needle valve, a flow of the dead fuel is once stopped. Accordingly, such a situation is assumed that a swirling component is not given to the dead fuel at the beginning of opening of the needle valve, so that the dead fuel is introduced into an injection hole to be injected while the dead fuel keeps a form of droplets having a large particle diameter. That is, a swirling component is hard to given to the dead fuel, so that it is difficult for the dead fuel to take fine air bubbles therein. Accordingly, the atomization of the fuel by bursting of the fine air bubbles cannot be expected. Further, a flow speed of the dead fuel just after the needle valve is opened is slow, so the atomization by shearing of the air is also difficult.

In view of this, an object of a fuel injection valve described in the present specification is to atomize dead fuel.

Means for Solving the Problem

In order to achieve the above object, a fuel injection valve described in the present specification includes: a needle valve including a seat portion on a tip side thereof; a nozzle body including a seat surface on which the seat portion is placed, and a swirl stabilization chamber on a downstream side of the seat surface, the nozzle body having an injection hole formed so as to have an inlet in the swirl stabilization chamber; a swirl flow generating portion having swirl grooves configured to give a swirling component to fuel to be introduced into the swirl stabilization chamber; and a fuel collision portion provided in a tip portion of the needle valve, the fuel collision portion being configured such that, in a state where the needle valve is opened, the fuel collision portion intersects with a virtual surface extended toward the injection hole from the seat surface included in the nozzle body.

When the needle valve is opened, dead fuel retained in an upstream side of the seat portion in a state where the needle valve is closed is introduced into the swirl stabilization chamber. The dead fuel has few swirling component at the beginning of the opening of the needle valve. When such dead fuel passes through the seat portion so as to be introduced into the swirl stabilization chamber, the dead fuel collides with the fuel collision portion. Hereby, it is possible to prevent such a situation that the dead fuel is retained in the swirl stabilization chamber and then introduced into the injection hole in a state where the dead fuel hardly swirls. When the fuel passing through the swirl grooves so that a swirling component is given thereto is introduced into the swirl stabilization chamber, the swirling component is also given to fuel corresponding to the dead fuel having been retained in the swirl stabilization chamber, due to a force of swirling of the fuel thus introduced. The fuel to which the swirling component is given is introduced into the injection hole, and generates an air column in a central portion of a swirl flow of the fuel. Subsequently, fine air bubbles are generated in a boundary between the air column and the fuel, and the fuel including the fine air bubbles is injected from the injection hole. After the fuel is injected from the injection hole, the fine air bubbles burst, thereby achieving atomization of the fuel. Thus, by providing the fuel collision portion, it is possible to achieve atomization of the dead fuel.

Here, when the needle valve is opened, the fuel collision portion may be configured to incline a flow of the fuel to be introduced into the swirl stabilization chamber, toward an inner peripheral wall of the swirl stabilization chamber. This makes it possible to retain the dead fuel in the swirl stabilization chamber.

More specifically, the fuel collision portion may include a curved portion formed on its outer peripheral wall so as to be recessed toward an axial center of the needle valve. By providing the curved portion, the dead fuel can be guided to the vicinity of the inner peripheral wall of the swirl stabilization chamber, so that the dead fuel can be effectively retained in the swirl stabilization chamber.

The fuel collision portion may include a spiral groove on its external wall, and a swirl direction of the spiral groove relative to the axial center of the needle valve may be the same direction as a swirl direction of the swirl grooves provided in the needle guide relative to the axial center of the needle valve. By providing the spiral groove, it is possible to retain the dead fuel in the swirl stabilization chamber while giving the swirling component to the dead fuel flowing toward the fuel collision portion. Further, when the swirl direction of the spiral groove relative to the axial center of the needle valve is the same direction as the swirl direction of the swirl grooves provided in the needle guide relative to the axial center of the needle valve, it is possible to restrain a decrease in the swirling component. That is, if the swirl directions are reverse to each other, the swirling component of the fuel passing through the swirl grooves is cancelled, which weakens the force of swirling. This problem can be prevented.

A tapered portion may be provided between the seat portion provided in the needle valve and the fuel collision portion. This makes it possible to restrain detachment of the fuel passing through the seat portion so as to be introduced into the swirl stabilization chamber, thereby making it possible to smoothly guide the dead fuel to the fuel collision portion. As a result, the dead fuel can be retained in the swirl stabilization chamber effectively. Further, when the detachment occurs at the time when the fuel is introduced into the swirl stabilization chamber, an unstable swirl flow is caused, so that unevenness in spray is easy to occur. However, the tapered portion can restrain this.

A bottom face of the swirl stabilization chamber may be a smooth surface perpendicular to the axial center of the needle valve, and a central axis of the injection hole may coincide with the axial center of the needle valve. This makes it possible to introduce the swirl flow into the injection hole homogeneously. As a result, it is possible to achieve cone-shaped fuel injection formed in a symmetrical manner along the central axis of the injection hole.

It is desirable that a distance between the inlet of the injection hole and the bottom face of the fuel collision portion when the needle valve is closed be set to not more than a quenching distance of flames to enter from the injection hole. This makes it possible to restrain the flames from entering into the fuel injection valve. As a result, it is possible to restrain carbonization of the fuel inside the fuel injection valve.

Advantageous Effects of Invention

According to the fuel injection valve described herein, it is possible to atomize dead fuel.

MODES FOR CARRYING OUT THE INVENTION

Figure 1A:
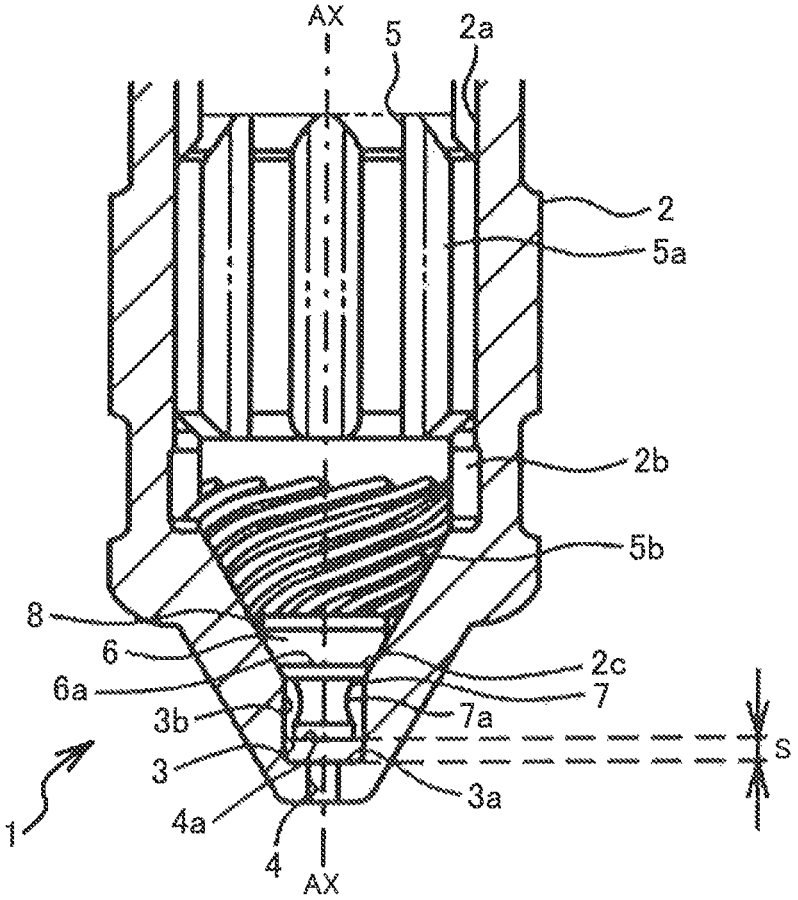
FIG. 1(A) is an explanatory view illustrating a valve closed state of a fuel injection valve of a first embodiment.

Embodiments of the present invention are described below in detail with reference to the drawings. Note that a dimension, a scale, and the like of each portion in the drawings may not be illustrated so as to be completely the same as an actual portion. Further, details may be omitted in some drawings.

First Embodiment

Figure 1B:
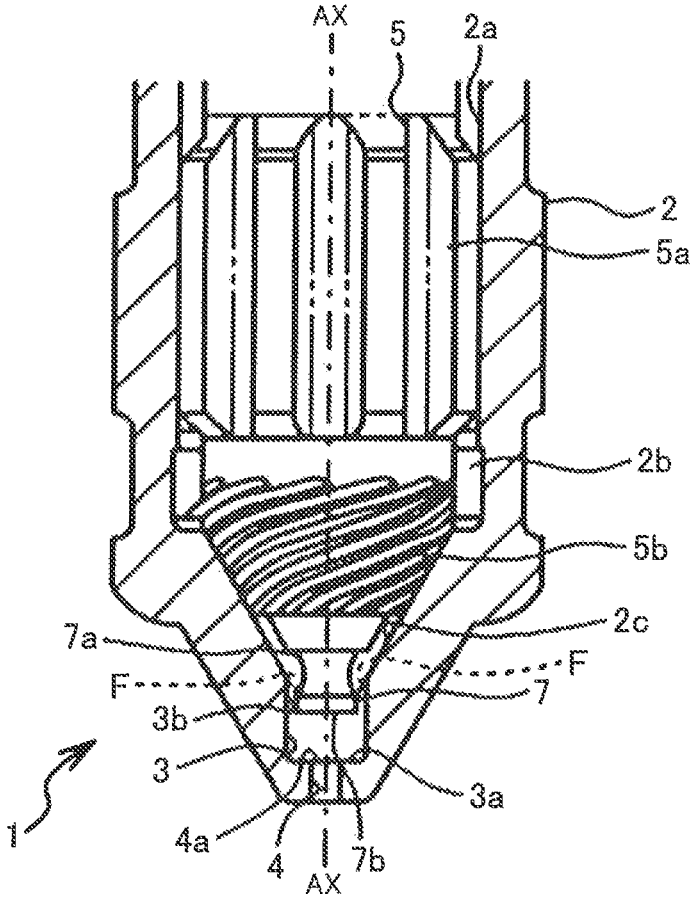
FIG. 1(B) is an explanatory view illustrating a valve open state of the fuel injection valve of the first embodiment.
Figure 2:
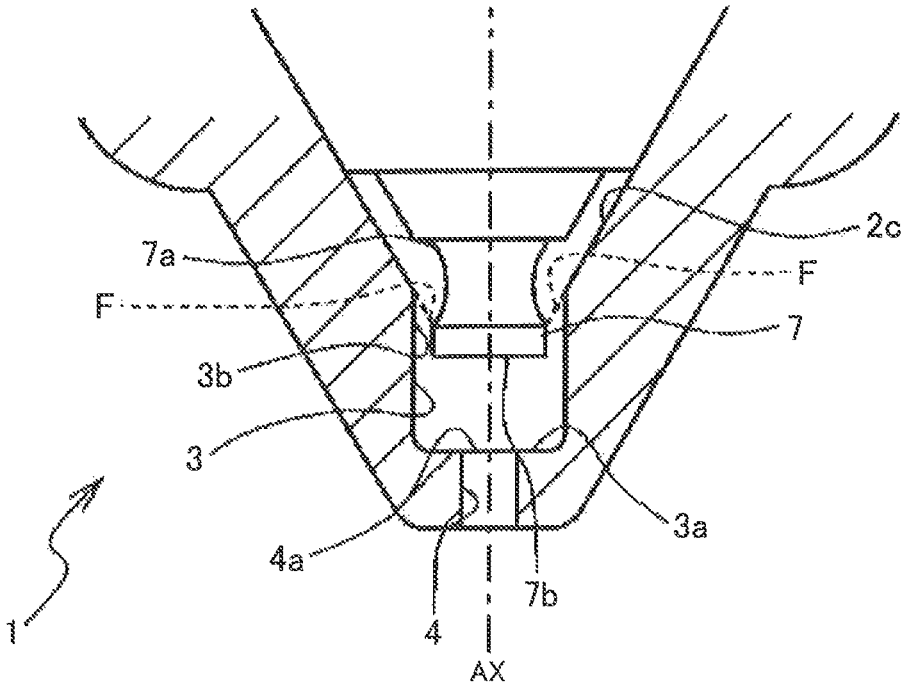
FIG. 2 is an explanatory view illustrating a tip portion of the fuel injection valve of the first embodiment in an enlarged manner.
Figure 3:
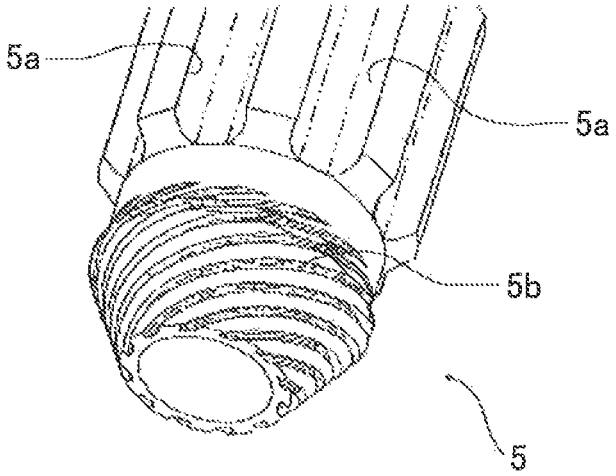
FIG. 3 is a perspective view illustrating a tip portion of a needle guide in the first embodiment.
Figure 4A:
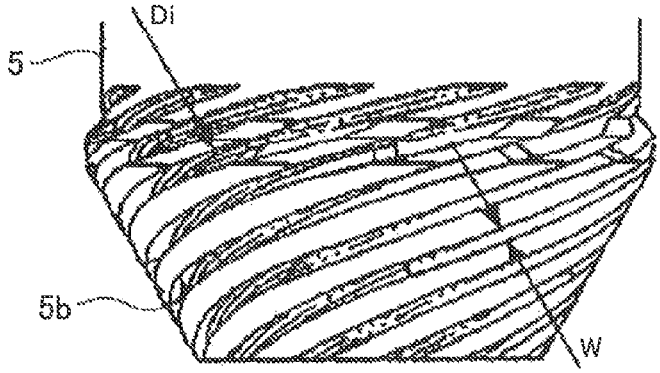
FIG. 4(A) is an explanatory view of the tip portion of the needle guide when viewed from a side surface side.
Figure 4B:
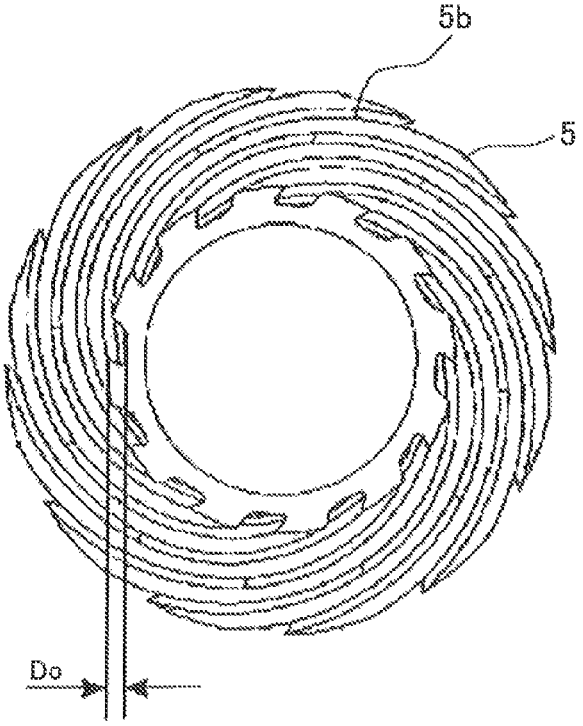
FIG. 4(B) is an explanatory view of the needle guide when viewed from a tip side.
Figure 5A:
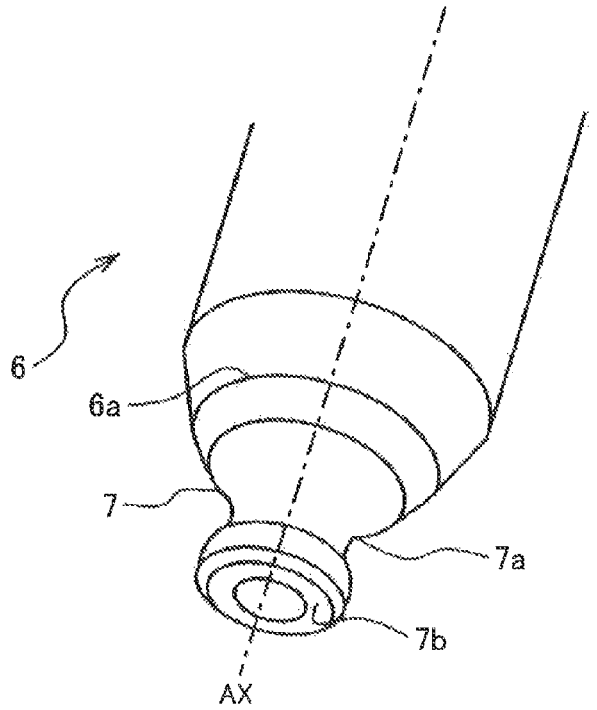
FIG. 5(A) is a perspective view illustrating a tip portion of a needle valve in the first embodiment.
Figure 5B:
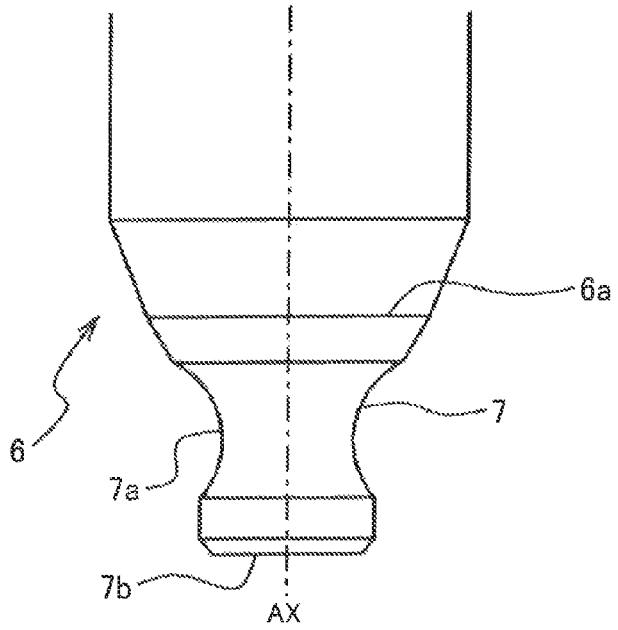
FIG. 5(B) is a side view illustrating the tip portion of the needle valve in the first embodiment.
Figure 6:
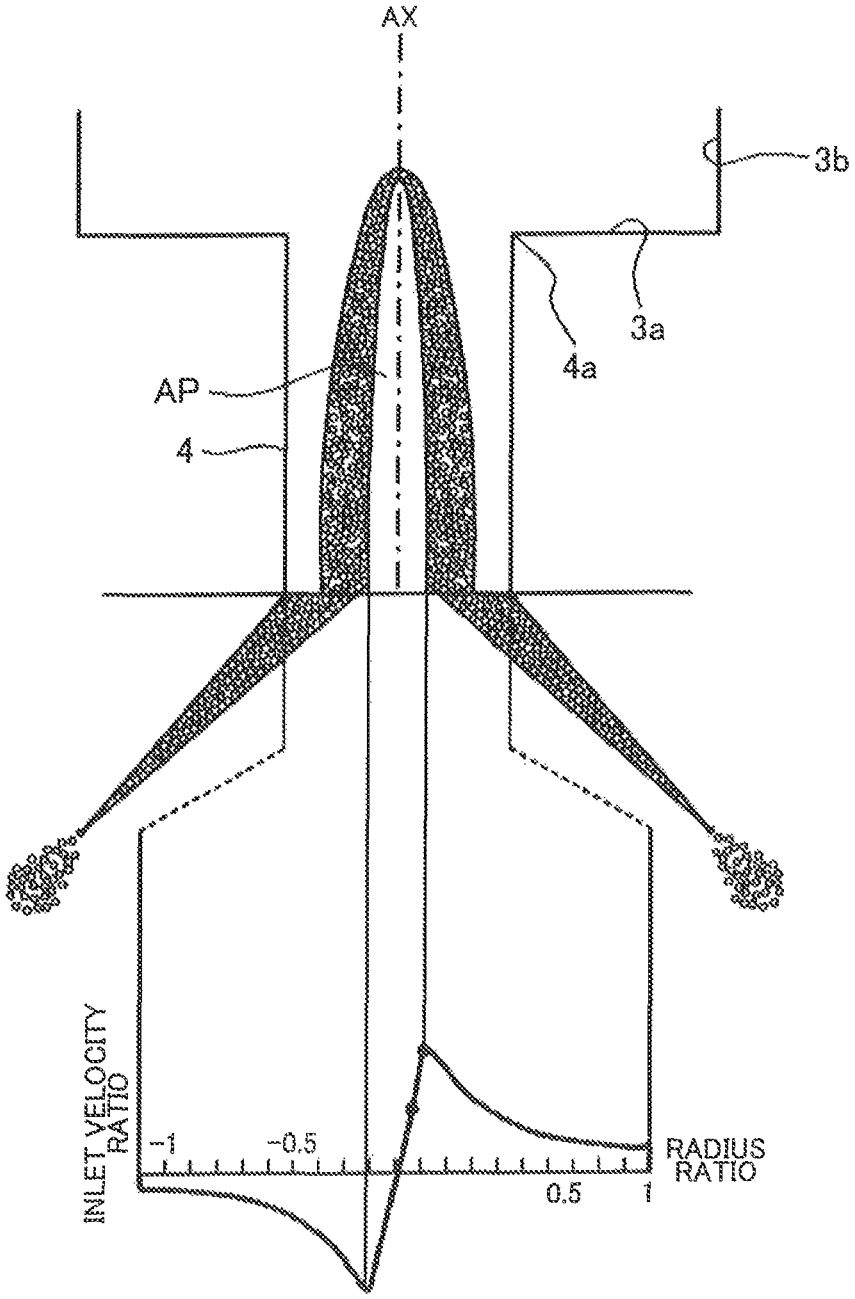
FIG. 6 is an explanatory view illustrating a principle of fuel atomization in the fuel injection valve in the first embodiment.

FIG. 1(A) is an explanatory view illustrating a valve closed state of a fuel injection valve 1 of the first embodiment, and FIG. 1(B) is an explanatory view illustrating a valve open state of the fuel injection valve 1 of the first embodiment. FIG. 2 is an explanatory view illustrating a tip portion of the fuel injection valve 1 of the first embodiment in an enlarged manner. FIG. 3 is a perspective view illustrating a tip portion of a needle guide 5 in the first embodiment. FIG. 4(A) is an explanatory view of the tip portion of the needle guide 5 when viewed from a side surface side, and FIG. 4(B) is an explanatory view of the needle guide 5 when viewed from a tip side. FIG. 5(A) is a perspective view illustrating a tip portion of a needle valve 6 in the first embodiment, and FIG. 5(B) is a side view illustrating the tip portion of the needle valve 6 in the first embodiment. FIG. 6 is an explanatory view illustrating a principle of fuel atomization in the fuel injection valve 1 in the first embodiment.

The fuel injection valve 1 of the first embodiment is provided in an internal combustion engine, and is drive-controlled by an ECU provided in the internal combustion engine. The ECU is a computer including a CPU (Central Processing Unit) configured to perform arithmetic processing, a ROM (Read Only Memory) in which to store a program and the like, and a RAM (Random Access Memory) or a NVRAM (Non Volatile RAM) in which to store data and the like. The fuel injection valve 1 can be provided in a lower part of an inlet port provided in the internal combustion engine, or at a given position in a combustion chamber. The internal combustion engine in which the fuel injection valve 1 is provided is any of a gasoline engine using gasoline as fuel, a diesel engine using light oil as fuel, and a flexible fuel engine using fuel obtained by mixing gasoline with alcohol at a given ratio. Also, the internal combustion engine may be an engine using any fuel that can be injected by a fuel injection valve.

Referring to FIGS. 1(A), 1(B), the fuel injection valve 1 includes a nozzle body 2, a needle guide 5, and a needle valve 6 having an axial center AX.

The nozzle body 2 is a tubular member, and includes an inner peripheral wall 2*a*. Further, the nozzle body 2 includes a pressure chamber 2*b*. A tip side of the pressure chamber 2*b* is provided with a seat surface 2*c* formed in a tapered shape. The after-mentioned seat portion 6*a* is placed on the seat surface 2*c*. Further, the nozzle body 2 includes a swirl stabilization chamber 3 on a downstream side of the seat surface 2*c*. The swirl stabilization chamber 3 is a cylindrical space having a bottom face 3*a* and an inner peripheral wall 3*b*. The bottom face 3*a* of the swirl stabilization chamber 3 is a smooth surface perpendicular to the axial center AX of the after-mentioned needle valve 6. An inlet 4*a* of the injection hole 4 is opened on the bottom face 3*a*. A central axis of the injection hole 4 coincides with the axial center AX of the needle valve 6. As will be described later, the fuel injection valve 1 in the first embodiment generates a strong swirl flow inside the injection hole 4 so as to generate fine air bubbles, and injects fuel including the fine air bubbles. In the fuel injection valve 1 that performs the fuel injection in this manner, the fuel flowing through the injection hole 4 forms a gas-liquid two-phase flow in which air bubbles are mixed, so that its flow speed is controlled at an extremely low sonic velocity prescribed by a void fraction. In such a state, an injection hole diameter is set to a diameter that secures a flow rate of the fuel. In the first embodiment, the injection hole diameter of the injection hole 4 is set to 0.7 mm, and an injection hole area thereof is set to 0.385 $mm^2$. Note that these dimensions are just examples and not limited to the above.

The fuel injection valve 1 includes the needle guide 5 of which a tip portion is placed inside the nozzle body 2. The needle guide 5 is placed inside the nozzle body 2 so that an outer peripheral surface of the needle guide 5 makes contact with an inner peripheral wall 2*a* of the nozzle body 2 in a supported manner. The needle guide 5 is a tubular member, and the needle valve 6 is accommodated in an inner peripheral portion in a reciprocating manner along a direction of the axial center AX. Referring to FIGS. 3 to 4(B), the needle guide 5 includes a fuel communication path 5*a* on an outer peripheral wall surface on a base end side. Further, a swirl groove 5*b* configured to give a swirling component to fuel to be introduced into the swirl stabilization chamber 3 is provided on a downstream side of the needle guide 5. The swirl groove 5*b* gives a swirling component to the fuel to be introduced into the swirl stabilization chamber 3. A tip portion of the needle guide provided with such a swirl groove 5*b* corresponds to a swirl flow generating portion.

Here, while referring to FIGS. 4(A), 4(B), the specification of the swirl groove 5*b* is described. The swirl groove 5*b* has twelve spiral grooves. A groove width is 0.17 mm at the maximum. A depth Di of an inlet portion of the groove is 0.4 mm. A depth Do of an outlet portion of the groove is 0.16 mm. A total groove minimal area, that is, a total area of the groove at the outlet portion is 0.314 $mm^2$. A groove flow path length is 4.5 mm. A calculated value of a pressure drop is 135 kPa.

The fuel injection valve 1 includes the needle valve 6 having the seat portion 6*a* on a tip side. As described above, the needle valve 6 is supported by an inner side of the needle guide 5 in a reciprocating manner. The needle valve 6 performs an opening operation by a driving device operating in response to an instruction of the ECU. As illustrated in FIG. 1(A), when the seat portion 6*a* is placed on the seat surface 2*c*, the fuel injection valve 1 enters a valve closed state. As illustrated in FIG. 1(B), when the seat portion 6*a* is removed from the seat surface 2*c*, the fuel injection valve 1 enters a valve open state. Here, the following describes dead fuel that is caused when the fuel injection valve 1 enters the valve closed state. When the fuel injection valve 1 enters the valve closed state as illustrated in FIG. 1(A), fuel is retained in an upstream side relative to the seat portion 6*a* in a state where a set fuel pressure is maintained. At the beginning of opening of the fuel injection valve 1, the fuel retained at a position closer to the seat portion 6*a* is sequentially introduced into the swirl stabilization chamber 3. When the needle valve 6 starts lifting, that part of the fuel which is retained in a dead fuel retention portion 8 formed in a region from the seat portion 6*a* to a downstream end of the swirl grooves 5*b*, that is, to the tip portion of the needle guide 5 is introduced into the swirl stabilization chamber 3 in a state where that part of the fuel hardly has a swirling component. Further, a fuel retained near the downstream end of the swirl grooves 5*b* cannot maintain a swirling component given thereto by passing through the swirl grooves 5*b*, and even after the valve is opened, the fuel cannot have a sufficient swirling component due to a short approach zone. As a result, the fuel behaves generally in the same way as the fuel retained in the dead fuel retention portion 8. As such, the fuels that are introduced into the swirl stabilization chamber 3 without any sufficient swirling component at the beginning of the opening of the fuel injection valve 1 are referred to as the dead fuel. The dead fuel is hard to be atomized due to the after-mentioned principle.

Referring now to FIG. 2, a tip portion of the needle valve 6 is provided with the fuel collision portion 7. The fuel collision portion 7 is provided so that the dead fuel described above collides therewith. The dead fuel that has collided with the fuel collision portion 7 can be retained in the swirl stabilization chamber 3. In order to retain the dead fuel in the swirl stabilization chamber 3, the fuel collision portion 7 is provided so as to intersect with a virtual surface F extended from the seat surface 2*c* provided in the nozzle body 2 toward the injection hole 4, that is, toward a tip side of the nozzle body 2, in a state where the needle valve 6 is opened. The fuel passes between the seat surface 2*c* and the seat portion 6*a* with a width according to a distance therebetween, and is introduced into the swirl stabilization chamber 3. The dead fuel is also introduced into the swirl stabilization chamber 3 in the same manner. The virtual surface F extended from the seat surface 2*c* toward the injection hole 4 generally coincides with a boundary of a flow of the dead fuel. Accordingly, if the fuel collision portion 7 is provided so as to intersect with the virtual surface F, the dead fuel can collide with the fuel collision portion 7. The fuel collision portion 7 is provided so as to collide with the dead full even at the time when the needle valve 6 is fully lifted. Note that, in a case where the above condition is not satisfied, streams of the fuel passing through the seat portion 6*a* in a circumferential shape and gathering toward the axial center AX collide with each other, so that the streams of the fuel are injected from the injection hole 4 without being atomized.

In contrast, the fuel retained in the swirl stabilization chamber 3 collides with the fuel collision portion 7, so that the fuel is inclined toward the inner peripheral wall 3*b* of the swirl stabilization chamber 3. Then, a swirling component is given to the fuel from the fuel having the swirling component and introduced into the swirl stabilization chamber 3 subsequently to the dead fuel, and then, the fuel is introduced into the injection hole 4. That is, fuel placed in an upstream side relative to the dead fuel at the time when the fuel injection valve 1 is closed, and introduced into the swirl stabilization chamber 3 after passing through the swirl grooves 5*b* with a sufficient distance has a fast speed and obtains the swirling component. The fuel that passes through the swirl grooves 5*b* with a long inlet length and has the swirling component is introduced into the swirl stabilization chamber 3 along the inner peripheral wall 3*b* of the swirl stabilization chamber 3 due to a centrifugal force of the fuel. The fuel having the swirling component keeps the swirling component and is introduced into the injection hole 4 together with the fuel retained in the swirl stabilization chamber 3.

As such, the fuel having the swirling component and introduced into the swirl stabilization chamber 3 subsequently to the dead fuel swirls along the inner peripheral wall 3*b* of the swirl stabilization chamber 3. Further, in order to retain the dead fuel in the swirl stabilization chamber 3, it is convenient to incline the dead fuel toward the inner peripheral wall 3*b*. In view of this, when the needle valve 6 is opened, the fuel collision portion 7 is configured to incline a flow of fuel to be introduced into the swirl stabilization chamber 3, toward the inner peripheral wall 3*b* of the swirl stabilization chamber 3. More specifically, as illustrated in FIGS. 5(A), 5(B), the fuel collision portion 7 includes a curved portion 7*a* formed on its outer peripheral wall so as to be recessed toward the axial center AX of the needle valve 6. Hereby, the dead fuel is guided to the vicinity of the inner peripheral wall 3*b* of the swirl stabilization chamber 3, so that the dead fuel is retained in the swirl stabilization chamber 3 effectively, thereby making it possible to secure a time before the fuel is introduced into the injection hole 4. Further, the dead fuel guided to the vicinity of the inner peripheral wall 3*b* of the swirl stabilization chamber 3 is absorbed by the fuel having the swirling component at a fast speed, so that the deal fuel is easy to have the swirling component. As a result, a uniform fuel flow can be easily obtained. Further, even in a case where the position of the injection hole is offset from the axial center AX, it is possible to restrain the fuel that is not swirling from being directly injected. As a result, it is possible to deal with a plurality of injection holes and an injection hole provided diagonally, thereby making it possible to improve design freedom.

As described above, the bottom face 3*a* of the swirl stabilization chamber 3 of the fuel injection valve 1 is a smooth surface perpendicular to the axial center AX of the needle valve 6. The inlet 4*a* of the injection hole 4 is opened on the bottom face 3*a*, and the central axis of the injection hole 4 coincides with the axial center AX of the needle valve 6. This allows the fuel swirling in the swirl stabilization chamber 3 to be introduced into the injection hole 4 homogeneously. As a result, it is possible to achieve cone-shaped fuel injection formed in a symmetrical manner along the central axis of the injection hole 4.

Here, the following describes a state of the fuel injection by the fuel injection valve 1. When the needle valve 6 is lifted up and the seat portion 6*a* is removed from the seat surface 2*c*, the fuel passing through the fuel communication path 5*a* is once introduced into the pressure chamber 2*b*, and then flows into the swirl grooves 5*b*. Hereby, the fuel forms a swirl flow. Then, the swirl flow is introduced into the swirl stabilization chamber 3 along the seat surface 2*c*. In such a procedure, the fuel swirling in the swirl stabilization chamber 3 is introduced into the injection hole 4. At this time, the fuel is introduced into the injection hole 4 having a diameter smaller than that of the swirl stabilization chamber 3, so that a whirl speed of the swirl flow accelerates and speeds up. As a result, as illustrated in FIG. 6, a negative pressure is caused in a central part of the swirl flow, thereby generating an air column AP. In an interface with the air column AP, fine air bubbles are generated, and the fine air bubbles thus generated are injected with the fuel.

A principle of atomization of the fuel is described in detail as follows. When a swirl flow with a fast whirl speed is formed in the fuel injection valve 1 and the swirl flow is introduced into the injection hole, a negative pressure is caused in a swirl center of such a strong swirl flow. When the negative pressure is caused, air outside the fuel injection valve 1 is absorbed into the injection hole 4. Hereby, an air column AP is generated within the injection hole 4. Thus, air bubbles are generated in an interface between the air column AP thus generated and the fuel. The air bubbles thus generated are mixed into the fuel flowing around the air column AP, so as to be injected with an air-bubble mixed flow, that is, a fuel flow that flows on an outer peripheral side as a two-phase flow. A shape of the injection is a hollow cone shape. Accordingly, as the injection is separated from the injection hole 4, an outside diameter of spray becomes larger, so that a liquid membrane forming the air bubble is stretched to be thinner. Then, when the liquid membrane cannot be maintained, the air bubble is divided. After that, a diameter of the fine air bubble is decreased due to a self-pressurizing effect, thereby causing collapse (crushing), so that ultrafine fuel particles are formed. Thus, atomization of the fuel is attained.

This is the principle of the fuel atomization of the fuel injection valve 1. In order to use this principle effectively, the injection hole diameter of the injection hole 4 of the fuel injection valve 1 is set to 0.7 mm. This diameter corresponds to a distance that allows flames from the combustion chamber to enter the fuel injection valve 1. When flames enter the fuel injection valve 1 from the injection hole 4, the fuel in the fuel injection valve 1 might be carbonized. When the fuel is carbonized and accumulated as a deposit, poor oil-tight and aggravation of spray in the fuel injection valve 1 may be caused. In view of this, in the fuel injection valve 1, a distance between the inlet 4*a* of the injection hole 4 and the bottom face 7*b* of the fuel collision portion 7 when the needle valve 6 is closed is set to a quenching distance or less for the flames entering from the injection hole 4. More specifically, a distance S shown in FIG. 1(A) is set to 0.4 mm or less. The quenching distance indicates a distance in which the flames are extinguished. When the flames are passing through a gap of a predetermined distance or less, heat of the flames is taken by a surrounding structural object, so that the flames are extinguished. In view of this, in the fuel injection valve 1, the distance S is set on the premise that the quenching distance is 0.4 mm. Note that the distance of 0.4 mm is not absolute, and other distances may be set provided that the flames are extinguished so as not to enter the fuel injection valve 1. Note that, in the fuel injection valve 1, from the viewpoint of preventing the flames from entering the fuel injection valve 1, a diameter of the bottom face 7*b* of the fuel collision portion 7 is set to be larger than the injection hole diameter.

As described above, according to the fuel injection valve 1 of the first embodiment, it is possible to atomize the dead fuel.

Second Embodiment

Figure 7:
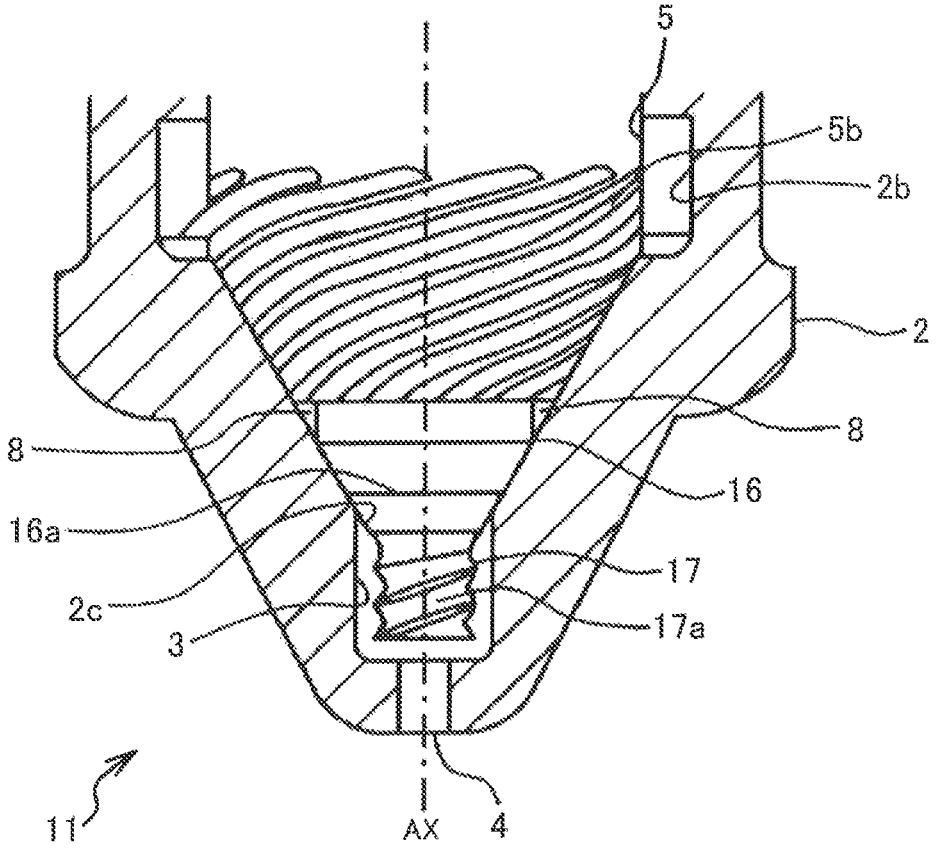
FIG. 7 is an explanatory view of a fuel injection valve in a second embodiment.
Figure 8:
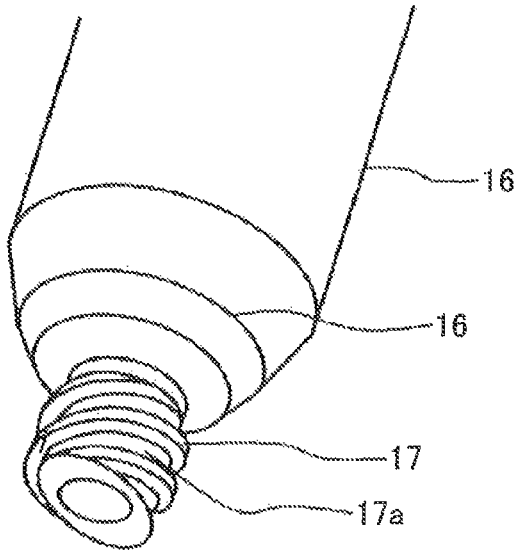
FIG. 8 is a perspective view illustrating a tip portion of a needle valve in the second embodiment.
Figure 9:
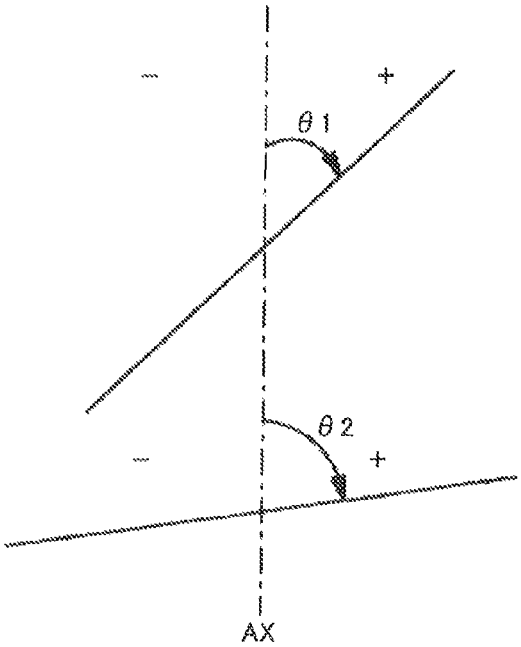
FIG. 9 is an explanatory view illustrating swirl directions of a swirl groove and a spiral groove.

With reference to FIGS. 7 to 9, the following describes a second embodiment. A fuel injection valve 11 of the second embodiment is different from the fuel injection valve 1 of the first embodiment in a shape of a needle valve, more specifically, a shape of a fuel collision portion. That is, the fuel injection valve 11 includes a needle valve 16 instead of the needle valve 6 provided in the fuel injection valve 1 of the first embodiment. The needle valve 16 includes a fuel collision portion 17 instead of the fuel collision portion 7. Note that the other configurations are the same as those of the first embodiment, so a constituent common in the first embodiment has the same reference sign in the figures, and a detailed description thereof is omitted.

As apparent in FIG. 8, the fuel collision portion 17 includes a spiral groove 17*a* on an outer peripheral wall thereof. A swirl direction of the spiral groove 17*a* relative to an axial center AX of the needle valve 16 is the same direction as a swirl direction of swirl grooves 5*b* provided in a needle guide 5 relative to the axial center AX of the needle valve 16.

The fuel collision portion 17 is provided at a position similar to that in the fuel injection valve 1 of the first embodiment. Accordingly, dead fuel introduced into a swirl stabilization chamber 3 at the beginning of opening of the fuel injection valve 11 collides with the fuel collision portion 17. The dead fuel that has collided with the fuel collision portion 17 moves along the spiral groove 17*a* so that the dead fuel can obtain a swirling component by itself.

Here, referring to FIG. 9, the following describes the swirl direction of the spiral groove 17*a* and the swirl direction of the swirl groove 5*b*. In FIG. 9, $\theta 1$ indicates an inclination of the swirl groove 5*b* relative to the axial center AX. Further, $\theta 2$ indicates an inclination of the spiral groove 17*a* relative to the axial center AX. As apparent from FIGS. 9, $\theta 1$ and $\theta 2$ are both inclined in a positive (+) direction relative to the axial center AX. That is, their swirl directions are the same. Accordingly, a swirling component given to the dead fuel by the spiral groove 17*a* does not obstruct a swirling component given to the dead fuel by the swirl groove 5*b*. If one of the swirl groove 5*b* and the spiral groove 17*a* is inclined toward a positive (+) side to swirl in FIG. 9 and the other one of them is inclined on a negative (−) side to swirl, a whirl speed is weakened. In view of this, they are both swirled in the same direction, so that it is possible to prevent them from cancelling the whirl speed, and to advance an increase of the whirl speed of the dead fuel. Note that it is not necessary that $\theta 1$ be exactly the same as $\theta 2$, and $\theta 1$ and $\theta 2$ may be just inclined in the same direction relative to the axial center AX so that their swirl directions coincide with each other.

According to the fuel injection valve 11 of the second embodiment, the dead fuel can obtain a swirling component by itself by passing through the swirl groove 5*b* before a swirling component is given thereto by a fuel flow having the swirling component. This makes it possible to effectively swirl the fuel even under an environment of a low fuel pressure, for example, thereby making it possible to achieve atomization of the fuel.

Third Embodiment

Figure 10:
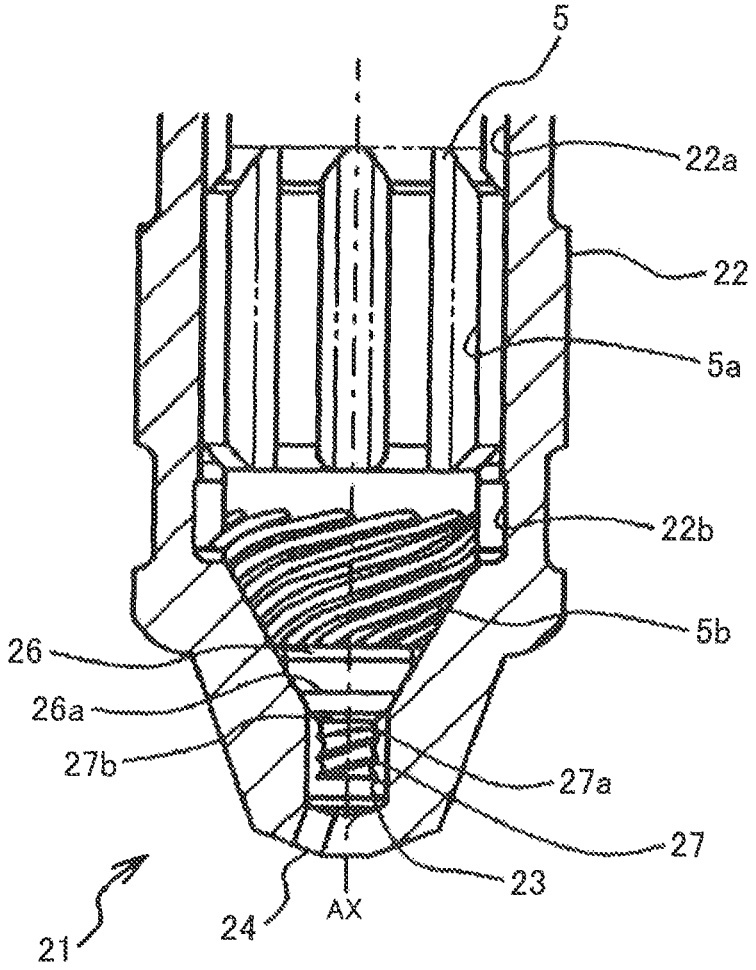
FIG. 10 is an explanatory view of a fuel injection valve of a third embodiment.
Figure 11:
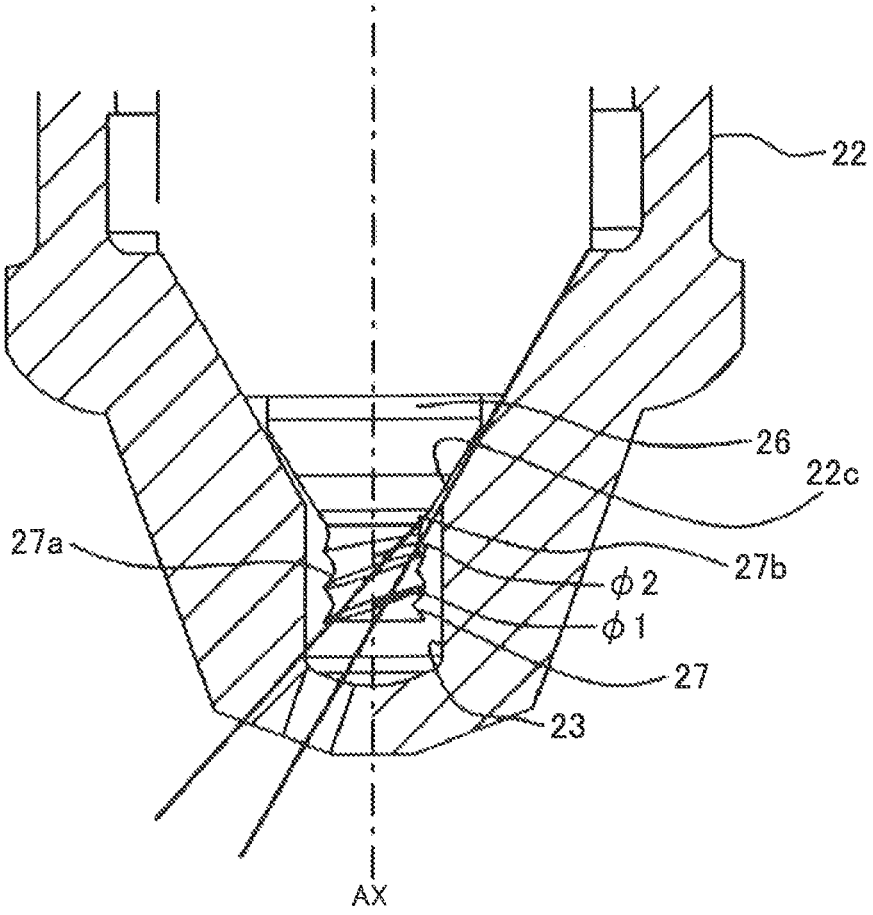
FIG. 11 is an explanatory view illustrating a tip portion of the fuel injection valve of the third embodiment in an enlarged manner.

With reference to FIGS. 10 and 11, the following describes a third embodiment. A fuel injection valve 21 of the third embodiment is different from the fuel injection valve 11 of the second embodiment in that the fuel injection valve 21 includes a tapered portion between a seat portion provided in a needle valve and a fuel collision portion. Further, the fuel injection valve 21 includes an injection hole 24 instead of the injection holes 4 provided in the fuel injection valve 1 of the first embodiment and in the fuel injection valve 11 of the second embodiment. Note that the other configurations are the same as those of the first embodiment, so a constituent common in the first embodiment has the same reference sign in the figures, and a detailed description thereof is omitted.

The fuel injection valve 21 includes a needle valve 26. The needle valve 26 includes a tapered portion 27*b* between a seat portion 26*a* and a fuel collision portion 27. By including the tapered portion 27*b*, it is possible to restrain detachment of fuel introduced into a swirl stabilization chamber 23. This makes it possible to smoothly guide dead fuel to the fuel collision portion 27, so that the dead fuel can be retained in the swirl stabilization chamber 23 effectively. Further, when the detachment occurs at the time when the fuel is introduced into the swirl stabilization chamber 23, an unstable swirl flow is caused, so that unevenness in spray is easy to occur. However, the tapered portion 27*b* can restrain this. Note that the fuel collision portion 27 includes a spiral groove 27*a* similarly to the fuel injection valve 11 of the second embodiment, but the spiral groove 27*a* is common to the spiral groove 17*a*, so a detailed description thereof is omitted.

An angle $\phi 2$ of the tapered portion 27*b* relative to an axial center AX smoothly guides the fuel to the fuel collision portion 27, so that the angle $\phi 2$ is set to be larger than an angle $\phi 1$ of a seat surface 22*c* relative to the axial center AX. When $\phi 2$ is an angle of about half of $\phi 1$, it is possible to effectively restrain detachment of the fuel.

The injection hole 24 is provided so as to be offset from the axial center AX. Since the fuel injection valve 21 of the third embodiment can obtain a stable swirl flow in the swirl stabilization chamber 23, it is possible to stably guide the swirl flow of the fuel to the injection hole 24 provided in an offset manner. Note that the first embodiment and the second embodiment can employ an injection hole provided in an offset manner.

Modification

Figure 12A:
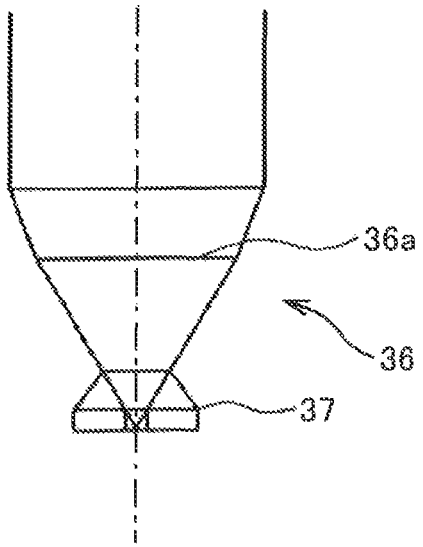
FIGS. 12(A), 12(B) are explanatory views illustrating a modification of a fuel collision portion.
Figure 12B:
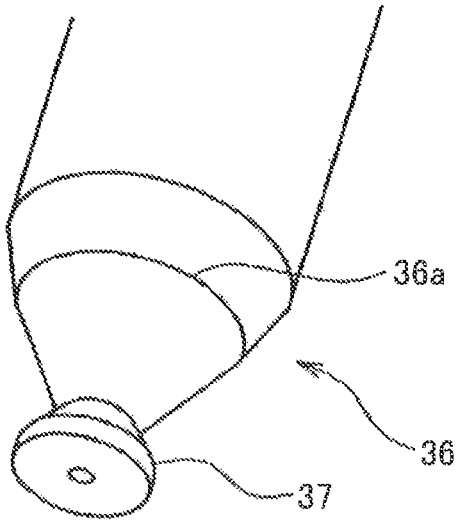
Figure 13A:
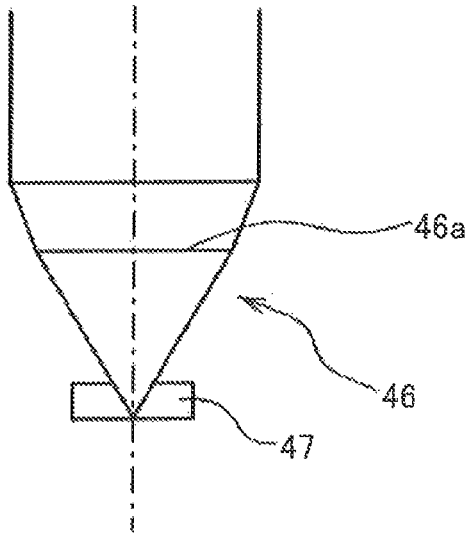
FIGS. 13(A), 13(B) are explanatory views illustrating other modifications of the fuel collision portion.
Figure 13B:
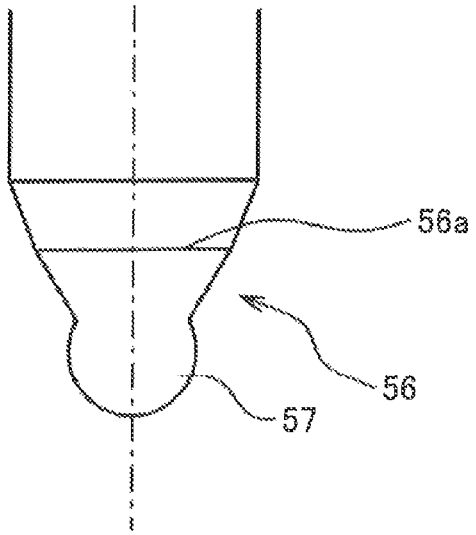

As described above, the shape of the fuel collision portion can be modified in various ways. For example, as illustrated in FIGS. 12(A), 12(B), a frusto-conical fuel collision portion 37 may be provided in a tip side of a seat portion 36*a* of a needle valve 36. Further, as illustrated in FIG. 13(A), a plate-shaped fuel collision portion 47 may be provided in a tip side of a seat portion 46*a* of a needle valve 46. Further, as illustrated in FIG. 13(B), a spherical fuel collision portion 57 may be provided in a tip side of a seat portion 56*a* of a needle valve 56. The important thing is that any fuel collision portion can be employed provided that the dead fuel can be retained in the swirl stabilization chamber.

The above embodiments are only examples to perform the present invention. Accordingly, the present invention is not limited to these embodiments, and various modifications and alternations can be made within a gist of Claims.

DESCRIPTION OF THE REFERENCE NUMERALS

1, 11, 21 fuel injection valve
2, 22 nozzle body
2*a*, 22*a* inner peripheral wall
2*b*, 22*b* pressure chamber
2*c*, 22*c* seat surface
3, 23 swirl stabilization chamber
3*a* bottom face
3*b* inner peripheral wall
4, 24 injection hole
4*a* inlet
5 needle guide
5*a* fuel communication path
5*b* swirl groove
6, 16, 26, 36, 46, 56 needle valve
6*a*, 16*a*, 26*a*, 36*a*, 46*a*, 56*a* seat portion
7, 17, 27, 37, 47, 57 fuel collision portion
7*a* curved portion
7*b* bottom face
8 dead fuel retention portion
17*a*, 27*a* spiral groove
27*b* tapered portion
AP air column
AX axial center
F virtual surface

The invention claimed is:

1. A fuel injection valve comprising:

a needle valve including a seat portion on a tip side of the needle valve;

a nozzle body including a seat surface on which the seat portion is placed, the nozzle body including a swirl stabilization chamber on a downstream side of the seat surface, the nozzle body including an injection hole that has an inlet in the swirl stabilization chamber;

a swirl flow generating portion having swirl grooves configured to add a swirling component to a fuel flow introduced into the swirl stabilization chamber; and a fuel collision portion provided in a tip portion of the needle valve, the fuel collision portion being configured such that, in a state where the needle valve is opened, the fuel collision portion intersects with a virtual surface extended toward the injection hole from the seat surface included in the nozzle body, the fuel collision portion including a spiral groove on its external wall, a swirl direction of the spiral groove relative to the axial center of the needle valve being the same direction as a swirl direction of the swirl grooves relative to the axial center of the needle valve.

2. The fuel injection valve according to claim 1, wherein when the needle valve is opened, the fuel collision portion is configured to incline the fuel flow introduced into the swirl stabilization chamber, toward an inner peripheral wall of the swirl stabilization chamber.

3. The fuel injection valve according to claim 1, wherein the fuel collision portion includes a curved portion provided on outer peripheral wall of the fuel collision portion, the curved portion is recessed from the outer peripheral wall toward an axial center of the needle valve.

4. The fuel injection valve according to claim 1, wherein a tapered portion is provided between the seat portion and the fuel collision portion.

5. The fuel injection valve according to claim 1, wherein:

a bottom face of the swirl stabilization chamber is a smooth surface perpendicular to the axial center of the needle valve; and a central axis of the injection hole coincides with the axial center of the needle valve.

6. The fuel injection valve according to claim 1, wherein a distance between the inlet of the injection hole and the bottom face of the fuel collision portion when the needle valve is closed is set to equal or less than a quenching distance of flames to enter from the injection hole.

* * * * *